US011847994B2

(12) United States Patent
Yamauchi et al.

(10) Patent No.: US 11,847,994 B2
(45) Date of Patent: Dec. 19, 2023

(54) SMART WINDOW DEVICE, IMAGE DISPLAY METHOD, AND RECORDING MEDIUM

(71) Applicant: Panasonic Intellectual Property Corporation of America, Torrance, CA (US)

(72) Inventors: Masaki Yamauchi, Osaka (JP); Nanami Fujiwara, Osaka (JP); Kaoru Murakami, Tokyo (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 191 days.

(21) Appl. No.: 17/475,589

(22) Filed: Sep. 15, 2021

(65) Prior Publication Data

US 2021/0407465 A1 Dec. 30, 2021

Related U.S. Application Data

(63) Continuation of application No. PCT/JP2021/003536, filed on Feb. 1, 2021.

(60) Provisional application No. 62/983,143, filed on Feb. 28, 2020.

(51) Int. Cl.
*G09G 5/36* (2006.01)

(52) U.S. Cl.
CPC ..... *G09G 5/36* (2013.01)

(58) Field of Classification Search
None
See application file for complete search history.

(56) References Cited

U.S. PATENT DOCUMENTS

2009/0013241 A1* 1/2009 Kaminaga ..... G06F 16/447 707/999.005
2014/0078089 A1* 3/2014 Lee ..... G06F 3/0488 345/173
2017/0045866 A1* 2/2017 Hou ..... H04W 12/06
2018/0314406 A1* 11/2018 Powderly ..... G06F 3/04815

FOREIGN PATENT DOCUMENTS

JP 2003-131319 5/2003
WO WO-2019176594 A1 * 9/2019

OTHER PUBLICATIONS

International Search Report dated Apr. 20, 2021 in International (PCT) Application No. PCT/JP2021/003536.

* cited by examiner

*Primary Examiner* — Yi Wang
(74) *Attorney, Agent, or Firm* — Wenderoth, Lind & Ponack, L.L.P.

(57) ABSTRACT

A smart window device includes: a window that is transparent and displays an effect image; a request receiver that receives, from a user, a stop request or a change request for the display of the effect image; a data acquirer that acquires effect image data indicating the effect image reflecting a preference of the user learned based on a length of time from a start of displaying the effect image until the request receiver receives the stop request or the change request and a type of an object; and a controller that: when a sensor detects the object, determines the type of the object based on a detection result of the sensor, selects an effect image to be displayed on the window from among the effect image data, based on the type of the object determined, and causes the effect image to be displayed on the window.

13 Claims, 9 Drawing Sheets

SMART WINDOW DEVICE, IMAGE DISPLAY METHOD, AND RECORDING MEDIUM

CROSS REFERENCE TO RELATED APPLICATIONS

This is a continuation application of PCT International Application No. PCT/JP2021/003536 filed on Feb. 1, 2021, designating the United States of America, which is based on and claims priority of U,S. Provisional Patent Application No. 62/983,143 filed on Feb. 28, 2020, The entire disclosures of the above-identified applications, including the specifications, drawings and claims are incorporated herein by reference in their entirety.

FIELD

The present disclosure relates to a smart window device, an image display method, and a recording medium.

BACKGROUND

Conventionally, when creating an effect in space in a building such as a house and commercial facilities, for example, a seasonal small item is placed on a windowsill, an ornament or a decorative light is attached to a wall, or decorations are applied to a window. In addition, for example, creating an effect in space is also carried out by projecting an image onto a wall or a ceiling using a projector, or displaying an image on a large display.

In recent years, for creating an effect in space in a building, there is a known technique to detect the shape of an object placed in the space, and project an image from a projector onto the object after correcting a projection distortion according to the shape of the object that has been detected (see, for example, Patent Literature (PTL) 1).

CITATION LIST

Patent Literature

PTL 1: Japanese Unexamined Patent Application Publication No. 2003-131319

SUMMARY

Technical Problem

However, with the technique disclosed in the above-described PTL 1, since a preference of a user is not taken into account in the image projected onto the object, it is difficult to create an effect in space according to the preference of the user.

In view of the above, the present disclosure provides a smart window device, an image display method, and a recording medium which are capable of creating an effect in space according to a preference of a user.

Solution to Problem

A smart window device according to one aspect of the present disclosure includes a window that is transparent and includes a display surface on which an effect image is displayed, the window being see-through from one side to an other side of the display surface while the effect image is displayed on the display surface; a request receiver that receives, from a user, a stop request to stop display of the effect image or a change request to change display of the effect image; a data acquirer that acquires effect image data that indicates the effect image reflecting a preference of the user learned based on a length of time from a start of displaying the effect image until the request receiver receives the stop request or the change request and a type of an object located in proximity to the window; and a controller that: (i) when a sensor detects the object, determines the type of the object based on a detection result of the sensor, selects a first effect image to be displayed on the display surface from among a plurality of effect image data each being the effect image data, based on the type of the object determined, and causes the first effect image to be displayed on at least a portion of the display surface; (ii) when the request receiver receives the stop request, stops displaying the first effect image; and (iii) when the request receiver receives the change request, selects a second effect image different from the first effect image to be displayed on the display surface from among the plurality of effect image data, and causes the second effect image to be displayed on at least a portion of the display surface.

In addition, an image display method according to one aspect of the present disclosure is an image display method in a smart window system including a window and a processor, the window being transparent, including a display surface on which an effect image is displayed, and being see-through from one side to an other side of the display surface while the effect image is displayed on the display surface The image display method includes: detecting an object located in proximity to the window, by using a sensor; and causing the processor to perform the following: receiving, from a user, a stop request to stop display of the effect image or a change request to change display of the effect image; acquiring effect image data that indicates the effect image reflecting a preference of the user learned based on a type of the object and a length of time from a start of displaying the effect image to the receiving of the stop request or the change request; when the sensor detects the object, determining the type of the object based on a detection result of the sensor, selecting a first effect image to be displayed on the display surface from among a plurality of effect image data each being the effect image data, based on the type of the object determined, and causing the first effect image to be displayed on at least a portion of the display surface; when the stop request is received in the receiving, stopping displaying of the first effect image, and when the change request is received in the receiving, selecting a second effect image different from the first effect image to be displayed on the display surface from among the plurality of effect image data, and causing the second effect image to be displayed on at least a portion of the display surface.

Note that these general and specific aspects may be implemented using a system, a method, an integrated circuit, a computer program, or a computer-readable recording medium such as a compact disc read-only memory (CD-ROM), or any combination of systems, methods, integrated circuits, computer programs, or recording media.

ADVANTAGEOUS EFFECTS

With the smart window device, etc. according to one aspect of the present disclosure, it is possible to create an effect in space according to a preference of a user.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
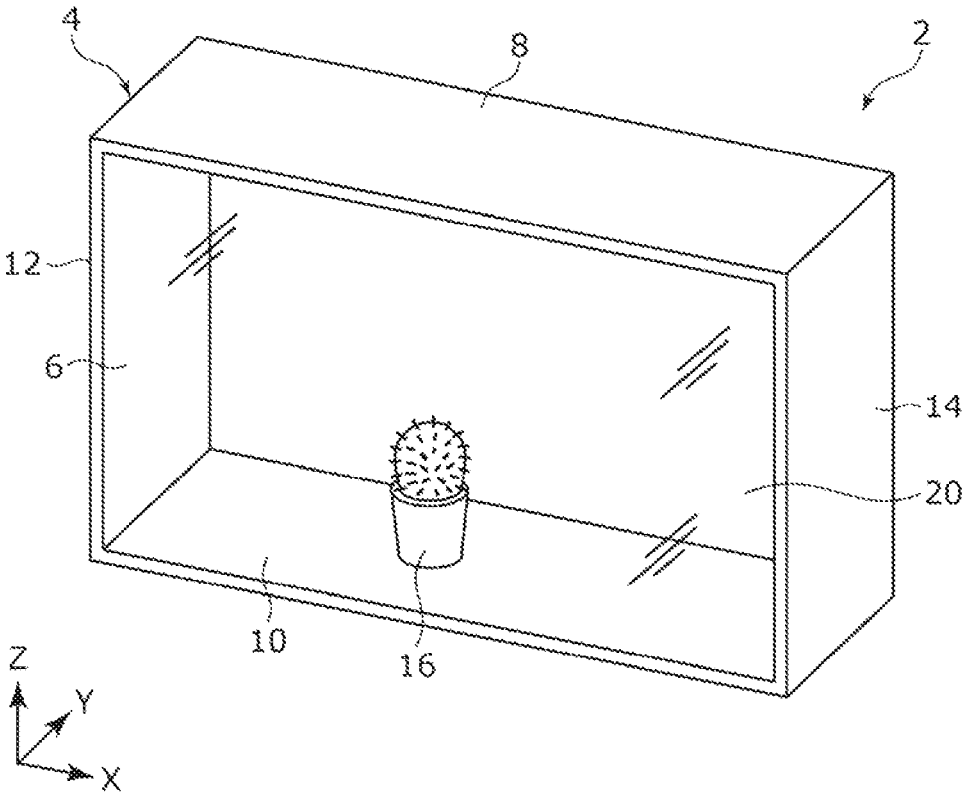
FIG. 1 is a perspective view illustrating a smart window device according to Embodiment 1.

A smart window device according to one aspect of the present disclosure includes a window that is transparent and includes a display surface on which an effect image is displayed, the window being see-through from one side to an other side of the display surface while the effect image is displayed on the display surface; a request receiver that receives, from a user, a stop request to stop display of the effect image or a change request to change display of the effect image; a data acquirer that acquires effect image data that indicates the effect image reflecting a preference of the user learned based on a length of time from a start of displaying the effect image until the request receiver receives the stop request or the change request and a type of an object located in proximity to the window; and a controller that: (i) when a sensor detects the object, determines the type of the object based on a detection result of the sensor, selects a first effect image to be displayed on the display surface from among a plurality of effect image data each being the effect image data, based on the type of the object determined, and causes the first effect image to be displayed on at least a portion of the display surface; (ii) when the request receiver receives the stop request, stops displaying the first effect image; and (iii) when the request receiver receives the change request, selects a second effect image different from the first effect image to be displayed on the display surface from among the plurality of effect image data, and causes the second effect image to be displayed on at least a portion of the display surface.

According to the above-described aspect, the data acquirer acquires effect mage data indicating an effect image that reflects a user's preference that has been learned based on: the length of time from the start of displaying the effect image until the request receiver receives a stop request or a change request; and the type of an object. In addition, the controller selects a first effect image from among the effect image data based on the type of the object that has been determined, and causes the first effect image that has been selected to be displayed on the display surface of the window, With this, since the first effect image displayed on the display surface of the window is an image reflecting a preference of the user, it is possible to create an effect in space according to the preference of the user. In addition, when the request receiver receives the change request, the controller selects a second effect image different from the first effect image from among the plurality of effect image data, and causes the second effect image that has been selected to be displayed on the display surface of the window. With this, even when the user desires changing the display of the first effect image, it is possible to cause the second effect image that reflects a preference of the user on the display surface of the window, and thus to create an effect in space according to the preference of the user.

For example, the window may be any one of: an exterior window installed in an opening provided in an exterior wall of a building; an interior window installed between two adjacent rooms in the building; and a partition window dividing one room in the building into a plurality of spaces.

According to the above-described aspect, it is possible to create an effect in space according to a preference of the user, using any one of: an exterior window; an interior window; and a partition window.

For example, at least one of the first effect image or the second effect image may include an image of a plurality of grains of light moving from an upper portion toward a lower portion of the window.

According to the above-described aspect, at least one of the first effect image or the second effect image can be, for example, an image that represents the scene of snow, a star, or the like falling. As a result, it is possible to enhance the impact of creating an effect in space.

For example, the controller may cause each of the first effect image and the second effect image to be displayed on at least a portion of the display surface such that a movement direction of each of the first effect image and the second effect image is directed toward the object.

According to the above-described aspect, it is possible to create an effect in space according to a preference of the user while an object and each of the first effect image and the second effect image are in harmony with each other.

For example, the data acquirer may be connected to a network, and acquire the effect image data from the network.

According to the above-described aspect, the data acquirer acquires effect image data from the network, and thus it is possible to save the capacity of an internal memory of the smart window device.

For example, the data acquirer may further acquire user information indicating at least one of a schedule of the user or a history of operating a device by the user, and the controller may predict, based on the user information, a time at which the user enters a room in which the window is installed, and start displaying the first effect image a first period of time before the time predicted.

According to the above-described aspect, the controller starts displaying the first effect image before the predicted time at which the user will enter the room in which the window is installed, and thus an operation to be performed by the user for causing the first effect image to be displayed can be omitted. As a result, it is possible to enhance convenience for the user.

For example, the sensor may further detect whether the user is present in a room in which the window is installed, and the controller may stop displaying the first effect image or the second effect image after a second period of time has elapsed after the sensor detects that the user is no longer present in the room, According to the above-described aspect, the controller stops displaying the first effect image or the second effect image after the user left the room, and thus an operation to be performed by the user for stopping displaying the first effect image or the second effect image can be omitted. As a result, it is possible to enhance convenience for the user.

For example, the sensor may further detect an illuminance in proximity to the window, and the controller may adjust a luminance when displaying the first effect image or the second effect image on the window, based on the illuminance detected by the sensor.

According to the above-described aspect, it is possible to enhance the visibility of the first effect image or second effect image.

For example, the window may be a transmissive transparent display including any one of a transparent inorganic electro luminescence (EL), a transparent organic EL, and a transmissive liquid crystal display.

According to the above-described aspect, since there is almost no difference in appearance between a window including a transmissive transparent display and a window used as an ordinary fixture, it is possible to avoid providing the user with a sense of discomfort.

For example, the preference of the user may be further learned based on a history of operating the smart window device by the user or a history of operating another device other than the smart window device by the user.

According to the above-described aspect, the preference of a user can be efficiently learned.

For example, the controller may acquire situation data indicating a situation of a room in which the window is installed, and select the first effect image or the second effect image according to the situation of the room indicated by the situation data from among the plurality of effect image data.

According to the above-described aspect, it is possible to effectively create an effect according to the situation of a room.

An image display method according to one aspect of the present disclosure is an image display method in a smart window system including a window and a processor, the window being transparent, including a display surface on which an effect image is displayed, and being see-through from one side to an other side of the display surface while the effect image is displayed on the display surface The image display method includes: detecting an object located in proximity to the window, by using a sensor; and causing the processor to perform the following: receiving, from a user, a stop request to stop display of the effect image or a change request to change display of the effect image; acquiring effect image data that indicates the effect image reflecting a preference of the user learned based on a type of the object and a length of time from a start of displaying the effect image to the receiving of the stop request or the change request; when the sensor detects the object, determining the type of the object based on a detection result of the sensor, selecting a first effect image to be displayed on the display surface from among a plurality of effect image data each being the effect image data, based on the type of the object determined, and causing the first effect image to be displayed on at least a portion of the display surface; when the stop request is received in the receiving, stopping displaying of the first effect image, and when the change request is received in the receiving, selecting a second effect image different from the first effect image to be displayed on the display surface from among the plurality of effect image data, and causing the second effect image to be displayed on at least a portion of the display surface.

According to the above-described aspect, effect image data is acquired which indicates an effect image that reflects a user's preference that has been learned based on: the length of time from the start of displaying the effect image until the request receiver receives a stop request or a change request; and the type of an object. In addition, the first effect image is selected from among the effect image data based on the type of the object that has been determined, and the first effect image that has been selected is caused to be displayed on the display surface of the window. With this, since the first effect image displayed on the display surface of the window is an image reflecting a preference of the user, it is possible to create an effect in space according to the preference of the user. In addition, when the request receiver receives the change request, the second effect image different from the first effect image is selected from among the plurality of effect image data, and causes the second effect image that has been selected to be displayed on the display surface of the window. With this, even when the user desires changing the display of the first effect image, it is possible to cause the second effect image that reflects a preference of the user on the display surface of the window, and thus to create an effect in space according to the preference of the user. A recording medium according to one aspect of the present disclosure is a non-transitory computer-readable recording medium having a program recorded thereon for causing a computer to execute the image display method.

It should be noted that these generic and specific aspects may be implemented using a system, a method, an integrated circuit, a computer program, or a computer-readable recording medium such as a CD-ROM, and may also be implemented by any combination of systems, methods, integrated circuits, computer programs, and recording media.

The following describes in detail an embodiment with reference to the drawings.

Each of the embodiments described below shows a general or specific example. The numerical values, shapes, materials, structural components, the arrangement and connection of the structural components, steps, the processing order of the steps, etc. presented in the following embodiments are mere examples, and therefore do not limit the present disclosure. In addition, among the structural components in the following embodiments, structural components not recited in any one of the independent claims are described as arbitrary structural components.

Embodiment 1

1-1. Configuration of Smart Window Device

First, a configuration of smart window device 2 according to Embodiment 1 will be described with reference to FIG. 1 to FIG. 2C. FIG. 1 is a perspective view illustrating smart window device 2 according to Embodiment 1. FIG. 2A to FIG. 2C are each a diagram illustrating a display example of effect image 18 in smart window device 2 according to Embodiment 1.

Figure 2A:
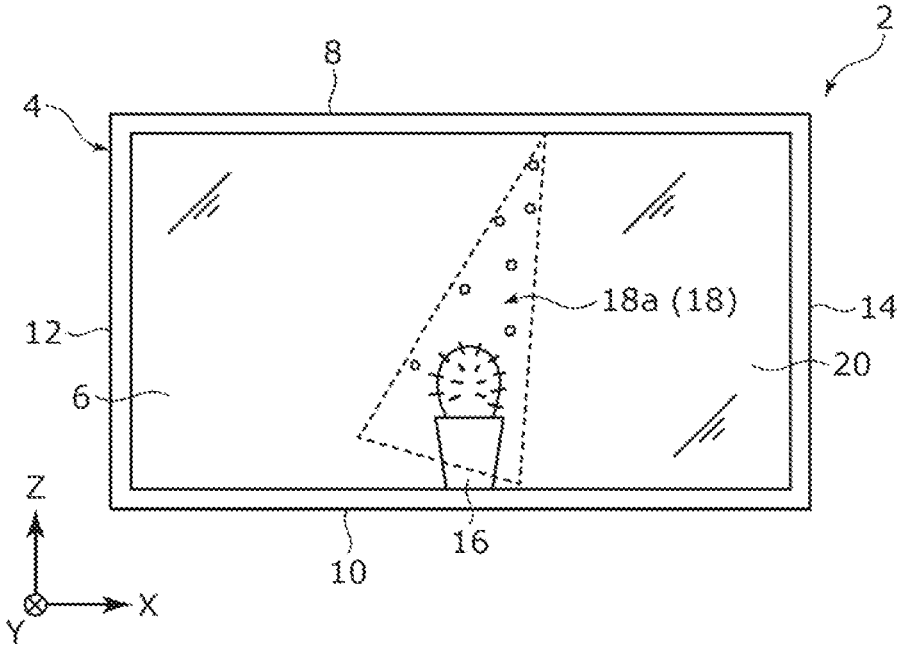
FIG. 2A is a diagram illustrating a display example of an effect image in the smart window device according to Embodiment 1.
Figure 2B:
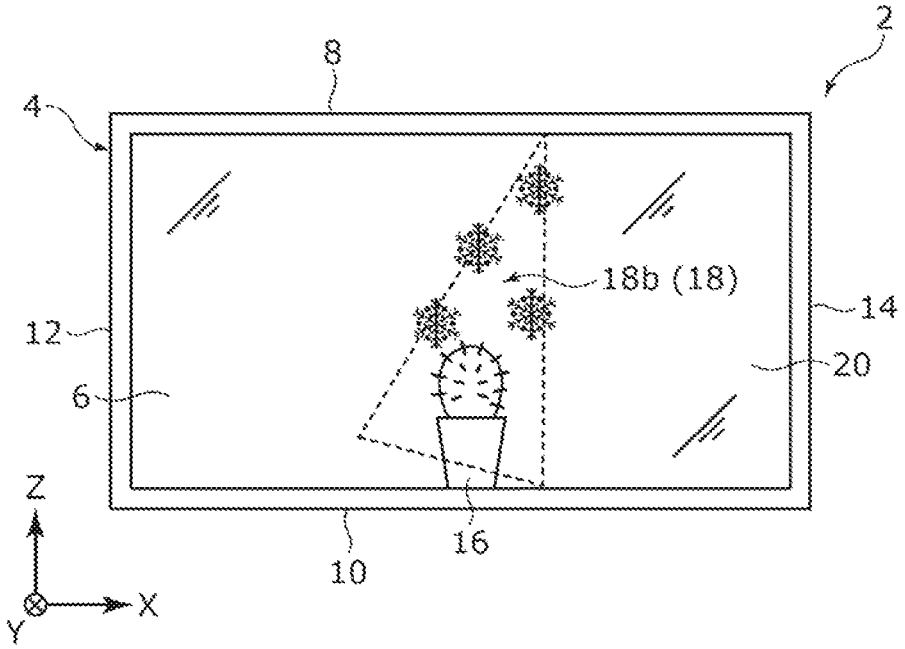
FIG. 2B is a diagram illustrating a display example of an effect image in the smart window device according to Embodiment 1.
Figure 2C:
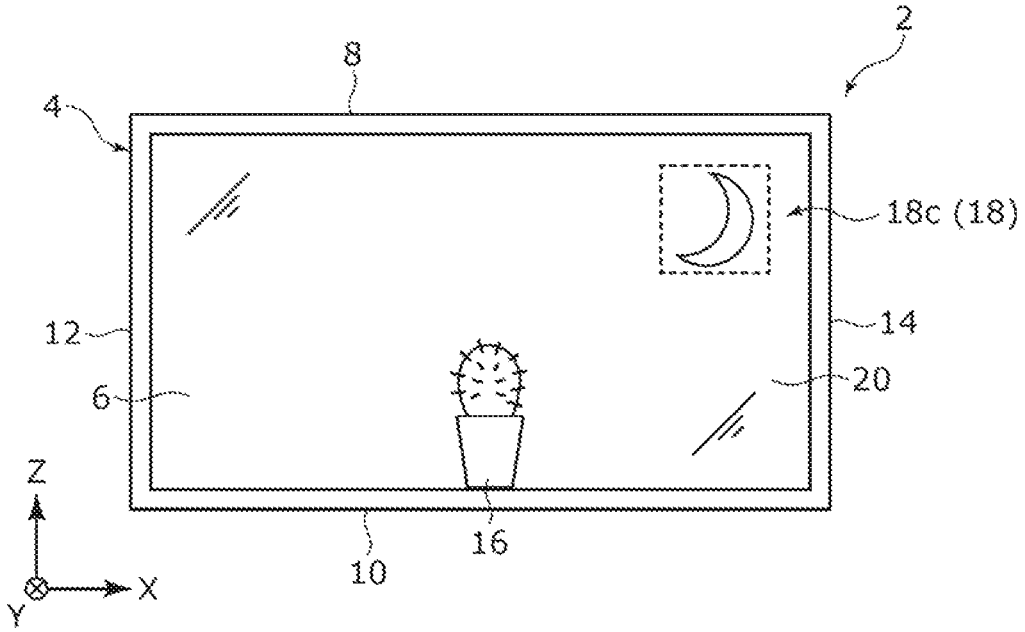
FIG. 2C is a diagram illustrating a display example of an effect image in the smart window device according to Embodiment 1.

It should be noted that, in FIG. 1 to FIG. 2C, the horizontal direction of smart window device 2 is referred to as an X-axis direction, the depth direction is referred to as a Y-axis direction, and the vertical direction of smart window device 2 is referred to as a Z-axis direction.

Smart window device 2 is a device for creating an effect in a room (hereinafter also referred to as "space") in, for example, a building such as a house. As illustrated in FIG. 1, smart window device 2 includes frame body 4 and window 6.

Frame body 4 has a quadrilateral shape in a plan view of an XZ plane. Frame body 4 is a window frame installed in a quadrilateral opening in an exterior wall (not illustrated) of a building, for example. Frame body 4 includes upper wall 8, lower wall 10, left side wall 12, and right side wall 14. Upper wall 8 and lower wall 10 are disposed to face each other in the vertical direction (i.e., the Z-axis direction), Left side wall 12 and right side wall 14 are disposed to face each other in the horizontal direction (i.e., the X-axis direction). Lower wall 10 functions as a shelf for placing object 16. A user can place object 16 on lower wall 10 as part of the interior accessories of the room. In the example illustrated in FIG. 1, object 16 is a house plant (cactus). However, object 16 is not limited to this example, and may be, for example, a picture frame, a wristwatch, a book, a decorative small item, a doll, a vase, a toy, a model, a painting, or the like. In addition, object 16 may be placed on a shelf provided in proximity to frame body 4, instead of lower wall 10 of frame body 4.

Window 6 has a quadrilateral shape in a plan view of an XZ plane, and the periphery of window 6 is supported by frame body 4. Window 6 functions, for example, as an interior window installed between two adjacent rooms in a building, as well as a transparent display panel for displaying effect image 18 (to be described later). It should be noted that "transparent" need not necessarily mean a transparency of a 100% transmittance, but may be a transparency of a less than 100% transmittance, such as a transparency of an approximately 80-90% transmittance, or may be translucent with at least 30-50% transmittance with respect to visible light (specifically, 550 nm). It should be noted that the transmittance is the intensity ratio of incident light to transmitted light that is expressed as a percentage. The above-described object 16 is disposed at a location in proximity to window 6, specifically, in proximity to the lower portion of window 6, to face the rear side (outdoor side) of window 6.

Window 6 includes, for example, a transmissive transparent display such as a transparent inorganic electro luminescence (EL) display, transparent organic EL display, or transmissive liquid crystal display. Display surface 20 for displaying effect image 18 is provided on the front side (room side) of window 6, Effect image 18 is an image for creating an effect in space. When the user sees effect image 18 displayed on display surface 20, the user concurrently sees through window 6 object 16 placed on lower wall 10. In this manner, an effect is created in space in which object 16 and effect image 18 are in harmony with each other.

While effect image 18 is displayed on display surface 20, window 6 is see-through from the front side (one side) to the rear side (the other side) of window 6. In other words, regardless of whether or not effect image 18 is displayed on display surface 20, the user in the room can view object 16 and the outdoor scenery through window 6, in the same manner as a window of a general fixture.

It should be noted that effect image 18 may be either a still image or a moving image, or may be image content that includes both still images and moving images. Alternatively, effect image 18 may be an image coupled with music, etc. output from a speaker (not illustrated) installed in frame body 4, etc., for example. This allows improving the atmosphere of the space and enhance the users mood without requiring performing complicated operations by the user, Here, display examples of effect image 18 (18*a*, 18*b*, and 18*c*) will be described with reference to FIG. 2A to FIG. 2C. In the example illustrated in FIG. 2A, effect image 18*a* is an image that represents the scene of snow falling toward object 16, and is an image imitating snow grains (a plurality of grains of light) moving from an upper portion to a lower portion of window 6 (from the positive side to the negative side of the Z axis). In other words, in the example illustrated in FIG. 2A, effect image 18*a* is an image that moves in the direction toward object 16. It should be noted that, in the example illustrated in FIG. 2A, effect image 18*a* is displayed only on a portion of display surface 20, and the display range of effect image 18*a* is indicated by a dashed line.

In the example illustrated in FIG. 2B, effect image 18*b* is an image that represents the scene of snowflakes falling toward object 16, and is a picture image imitating snowflakes moving from the upper portion to the lower portion of window 6. In other words, in the example illustrated in FIG. 28, effect image 18*b* is an image that moves in the direction toward object 16. It should be noted that, in the example illustrated in FIG. 28, effect image 18*b* is displayed only on a portion of display surface 20, and the display range of effect image 18*b* is indicated by a dashed line.

In the example illustrated in FIG. 2C, effect image 18*c* is an image that represents the scene of a crescent moon floating in the sky, and is an image imitating a crescent moon is displayed in proximity to the upper portion of window 6. Since the picture image of the crescent moon is translucent, the user can view object 16 and the outdoor scenery through window 6, through the region of display surface 20 other than the picture image of the crescent moon. It should be noted that, in the example illustrated in FIG, 2C, effect image 18*c* is displayed only on a portion of display surface 20, and the display range of effect image 18*c* is indicated by a dashed line. In addition, the picture image of the crescent moon may be stationary at a predetermined position on display surface 20, or may move on display surface 20 as time passes. Alternatively, effect image 18*c* may be an image of the moon waxing and waning as time passes.

Effect image 18 is not limited to the examples illustrated in FIG. 2A to FIG. 2C. For example, effect image 18 may be (a) an image in which a star or a shooting star in the night sky is represented by a plurality of grains of light, (b) an image in which small bubbles such as bubbles of champagne or sparkling wine are represented by a plurality of grains of light, and the inside of the bubbles is visible in a see-through manner, (c) an image in which sand falling in an hourglass is represented by a plurality of grains of light, and the portion other than the sand is visible in a see-through manner, etc, In addition, effect image 18 may be an animated image, More specifically, effect image 18 may be an animated image representing, for example, a scene of snowflakes flurrying, in which only the outline of the snowflakes is represented by light grains or lines of light, and the rest of the image is visible in a see-through manner. In addition, effect image 18 may be an animated image according to the season. More specifically, effect image 18 may be, for example, (a) images of Santa Claus and reindeer riding on a sleigh in the case of the Christmas season, (b) images of pumpkins and ghosts in the case of the Halloween season, and so on. It should be noted that, it is preferable when the above-described effect image 18 is an image in which only the outline of a main image is displayed and the other portions are visible in a see-through manner, rather than an image displayed on the entire of display surface 20 of window 6.

In addition, effect image 18 need not necessarily an image displayed in only a single color, but may be an image displayed in a plurality of colors. Furthermore, effect image 18 may be an image that displays decorative characters, graphics, or the like such as a neon sign.

It should be noted that, it is sufficient if effect image 18 is an image that can create an effect in space, Effect image 18 need not be an image that displays functional content such as a clock or weather forecast, for example. By displaying, on display surface 20 of window 6, effect image 18 specialized for creating an effect in space, it is possible to make users relaxed, who are exhausted by the flood of information in their daily lives.

On the other hand, for users who prefer functional usages, effect image 18 may include an image that displays functional content, such as a dock or weather forecast, for example. Alternatively, effect image 18 may include an image for informing a user of a predetermined event, etc. More specifically, in the case where smart window device 2 is installed between, for example, a kitchen and a living room (or a corridor), when a user leaves the kitchen while cooking in the kitchen, effect image 18 that includes an image that is reminiscent of flames may be displayed on display surface 20 of window 6. In this manner, it is possible to inform the user, for example, that the cookware is overheated.

1-2. Functional Configuration of Smart Window Device

Figure 3:
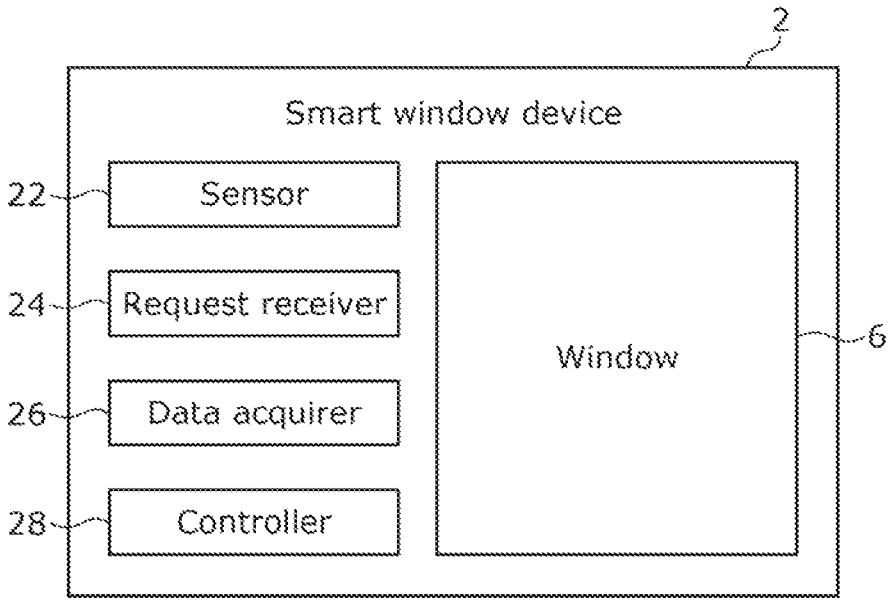
FIG. 3 is a block diagram illustrating a functional configuration of the smart window device according to Embodiment 1.

The following describes a functional configuration of smart window device 2 according to Embodiment 1, with reference to FIG. 3. FIG. 3 is a block diagram illustrating a functional configuration of smart window device 2 according to Embodiment 1.

As illustrated in FIG. 3, smart window device 2 includes, as the functional configuration, window 6, sensor 22, request receiver 24, data acquirer 26, and controller 28.

Window 6 functions as a transparent exterior window, for example, as described above, and also functions as a transparent display panel for displaying effect image 18. Since window 6 has been described above, a detailed explanation will be omitted here.

Sensor 22 is a sensor for detecting object 16 placed on lower wall 10, Although not illustrated in FIG. 1, sensor 22 is disposed, for example, on upper wall 8 of frame body 4. It should be noted that sensor 22 may be disposed, not only on upper wall 8, but also on any of lower wall 10, left side wall 12, and right side wall 14 of frame body 4, for example.

Sensor 22 is, for example, a camera sensor including an imaging device. Sensor 22 captures an image of object 16 placed on lower wall 10 and outputs image data indicating the captured image of object 16 to controller 28. It should be noted that, in addition to the imaging device, sensor 22 may also include an infrared sensor. In addition, sensor 22 need not be installed on frame body 4. In this case, a device different from smart window device 2, such as a camera sensor of a smartphone owned by a user, may be used to detect object 16, and smart window device 2 may receive the information detected by the camera sensor from the smartphone via a network.

Request receiver 24 is a switch for receiving, from a user, a request to stop or change the display of effect image 18. Request receiver 24 includes, for example, a physical switch or a graphical user interface (GUI), etc, Although not illustrated in FIG. 1, request receiver 24 is disposed, for example, on upper wall 8 of frame body 4.

When the user wants to stop the display of effect image 18 on display surface 20 of window 6, the user operates request receiver 24, thereby instructing a stop request to stop the display of effect image 18. In addition, when the user wants to change effect image 18 displayed on display surface 20 of window 6 to another effect image 18, the user operates request receiver 24, thereby instructing a change request to change the display of effect image. Request receiver 24 outputs the information indicating the stop request or change request that has been received, to each of data acquirer 26 and controller 28.

It should be noted that, although sensor 22 and request receiver 24 are separately configured according to the present embodiment, the present disclosure is not limited to this example, Sensor 22 may have the functions of both sensor 22 and request receiver 24. More specifically, sensor 22 that serves as request receiver 24 may receive a stop request or a change request according to a user's operation that has been captured, More specifically, sensor 22 that serves as request receiver 24 receives a stop request when, for example, the user moves the position of object 16 on lower wall 10. In addition, sensor 22 that serves as request receiver 24 receives a change request when, for example, the user rotates object 16 around the vertical direction (Z-axis direction) on lower wall 10.

At this time, the user need not necessarily rotate object 16 by 360° around the vertical direction. The user may rotate object 16 by a given rotation angle, such as 45° or 90°, for example, In addition, control may be performed such that a total number of times or speed of change of effect image 18 is changed according to the rotation angle at which the user rotates object 16.

Data acquirer 26 acquires effect image data indicating effect image 18 that reflects user's preference that has been learned, and is to be displayed on display surface 20 of window 6. At this time, data acquirer 26 acquires effect image data indicating effect image 18 that reflects the learned user's preference from among a plurality of effect image data stored in advance in a memory (not illustrated), The effect image data acquired by data acquirer 26 is associated with the type of object 16 that is determined by controller 28. It should be noted that data acquirer 26 may download, as the effect image data, an image that has been hit by search in the network (not illustrated), and store the downloaded image in a memory in advance.

In addition, data acquirer 26 learns the user's preference based on the length of time from the start of displaying effect image 18 until request receiver 24 receives the stop request or the change request, and the type of object 16 determined by controller 28. The method of learning the user's preference by data acquirer 26 will be described later.

Controller 28 controls the display of effect image 18 on display surface 20 of window 6. More specifically, when sensor 22 detects object 16, controller 28 determines the type of object 16 based on image data from sensor 22 (i.e., the result of detection by sensor 22). At this time, controller 28 discriminates the type of object 16 by matching the image data from sensor 22 with image data stored in advance in the memory (not illustrated). In the example illustrated in FIG, 1, controller 28 determines the type of object 16 as "house plant" based on the result of detection by sensor 22, It should be noted that controller 28 may transmit the image data from sensor 22 to the network and determine the type of object 16 through the network, With this, it is possible to reduce the processing load of controller 28 and save the capacity of the memory.

In addition, based on the type of object 16 that has been determined, controller 28 selects effect image 18 (a first effect image) to be displayed on display surface 20 of window 6 from among the plurality of effect image data acquired by data acquirer 26. More specifically, controller 28 selects effect image 18 which contains the image that matches the type of object 16 that has been determined, from among the plurality of effect image data acquired by data acquirer 26. In other words, effect image 18 selected by controller 28 is the effect image that reflects the user's preference that has been learned by data acquirer 26 and is associated with the type of object 16 that has been determined. Controller 28 displays effect image 18 that has been selected, on display surface 20 of window 6.

In addition, when request receiver 24 receives the stop request, controller 28 stops the display of effect image 18 (the first effect image) currently displayed on display surface 20 of window 6.

In addition, when request receiver 24 receives the change request, controller 28 selects another effect image 18 (a second effect image) different from effect image 18 (the first effect image) currently displayed on display surface 20 of window 6, from among the plurality of effect image data acquired by data acquirer 26. More specifically, controller 28 selects another effect image 18 that contains the image that matches the type of object 16 that has been determined, from among the plurality of effect image data acquired by data acquirer 26. In other words, the other effect image 18 selected by controller 28 is an effect image that reflects the user's preference that has been learned by data acquirer 26 and is associated with the type of object 16 that has been determined. Controller 28 displays the other effect image 18 that has been selected, on display surface 20 of window 6.

It should be noted that controller 28 may select another effect image 18 from among a plurality of effect image data that have been downloaded in advance from the network, or may select another effect image 18 from among a plurality of effect image data indicating an image that has been hit by search in the network performed again by data acquirer 26.

1-3. Operation of Smart Window Device

Figure 4:
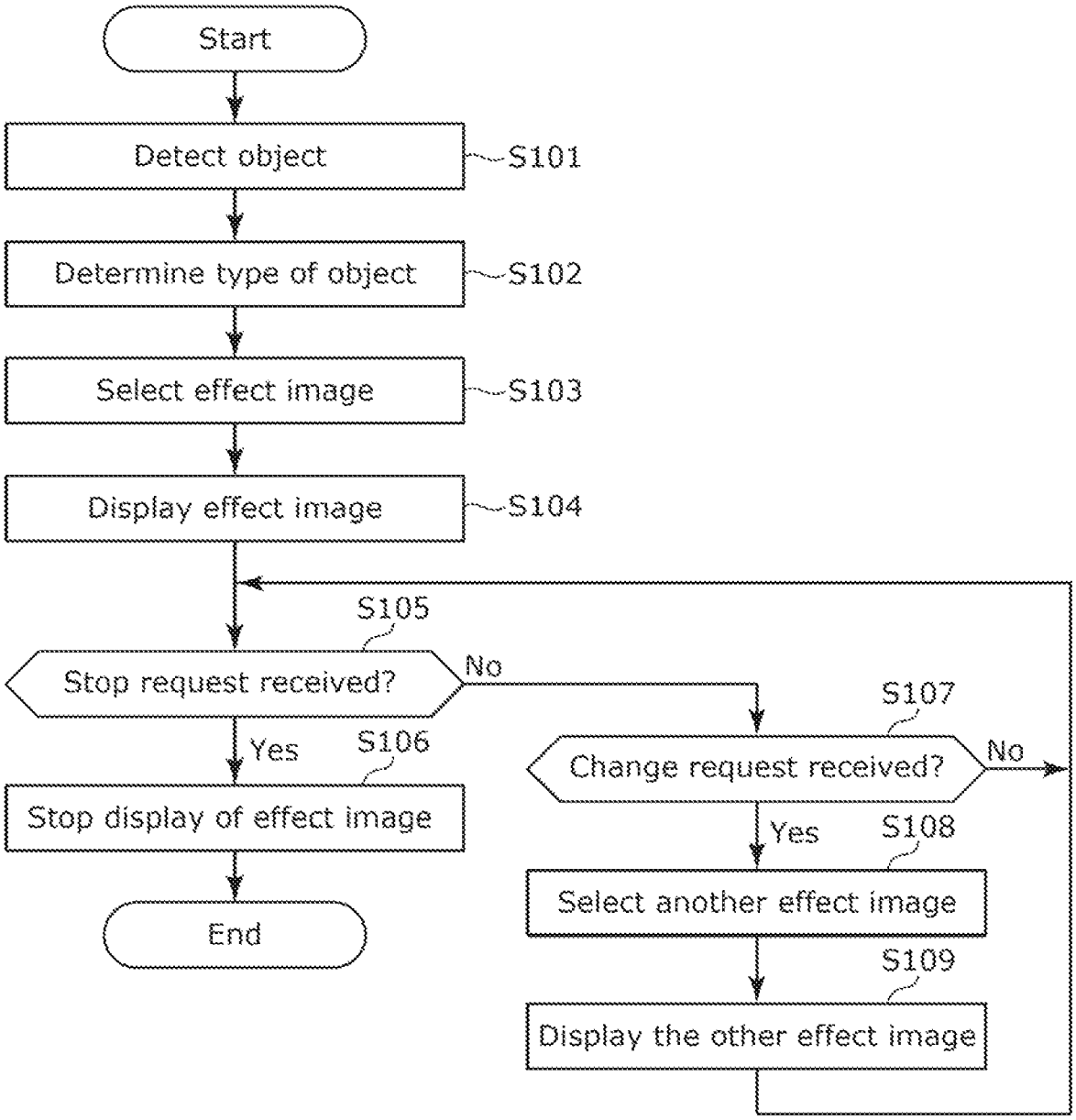
FIG. 4 is a flowchart illustrating an operational flow of the smart window device according to Embodiment 1.

The following describes an operation of smart window device 2 according to Embodiment 1, with reference to FIG. 4. FIG. 4 is a flowchart illustrating an operational flow of smart window device 2 according to Embodiment 1.

As illustrated in FIG. 4, when a user places object 16 (e.g., a house plant) on lower wall 10 of frame body 4, sensor 22 detects object 16 placed on lower wall 10 (S101). Sensor 22 outputs image data indicating the captured image of object 16 to controller 28.

Controller 28 determines the type of object 16 based on the image data from sensor 22 (S102). Based on the type of object 16 that has been determined, controller 28 selects effect image 18 (a first effect image) to be displayed on display surface 20 of window 6 from among a plurality of effect image data acquired by data acquirer 26 (S103). For example, as illustrated in FIG. 2A described above, controller 28 selects effect image 18*a*, which is an image representing a scene of snow falling toward object 16, as effect image 18 that matches "house plant" that is the type of object 16. Controller 28 displays effect image 18 that has been selected, on display surface 20 of window 6 (S104).

When request receiver 24 receives a stop request (YES in S105), controller 28 stops the display of effect image 18 currently displayed on display surface 20 of window 6 (S106).

On the other hand, when request receiver 24 does not receive a stop request (NO in S105) and receives a change request (YES in S107), controller 28 selects, from among the plurality of effect image data acquired by data acquirer 26, another effect image 18 (a second effect image) different from effect image 18 currently displayed on display surface 20 of window 6 (S108). For example, as illustrated in FIG. 2B described above, controller 28 selects, as another effect image 18, effect image 18*b* which is an image representing a scene of snowflakes falling toward object 16. Controller 28 displays the other effect image 18 that has been selected, on display surface 20 of window 6 (S109).

Returning back to step S107, when request receiver 24 does not receive a change request (NO in S107), the process returns back to Step S105 described above.

Here, an example of a method of learning a preference of a user performed by data acquirer 26 according to Embodiment 1 will be described with reference to FIG. 5. FIG, 5 is a flowchart illustrating an example of the method of learning a preference of a user performed by data acquirer 26 according to Embodiment 1.

Figure 5:
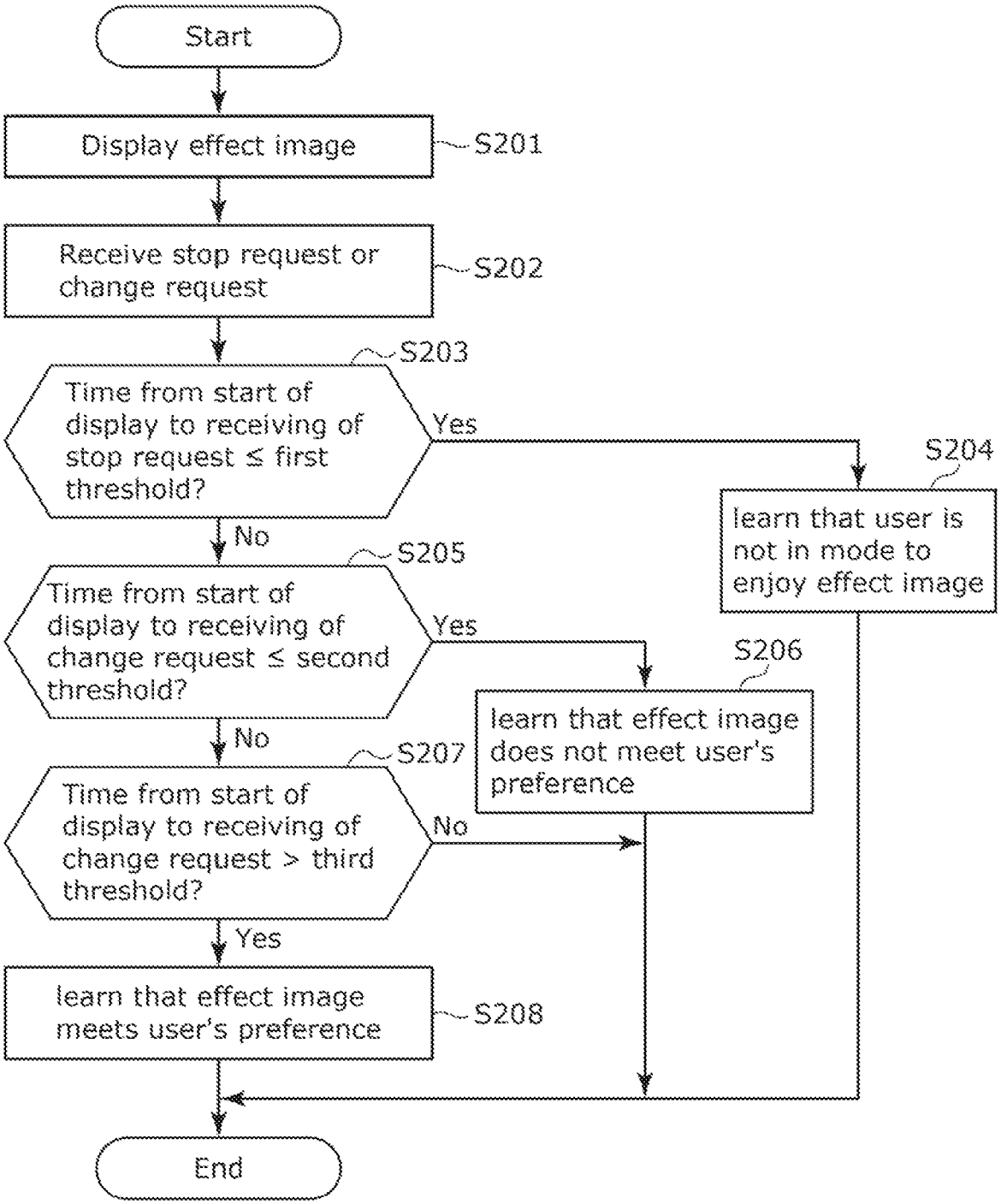
FIG. 5 is a flowchart illustrating an example of a method of learning a preference of a user performed by a data acquirer according to Embodiment 1.

As illustrated in FIG. 5, controller 28 causes effect image 18 to be displayed on display surface 20 of window 6 (S201), and then request receiver 24 receives a stop request or a change request (S202).

When request receiver 24 receives the stop request and the time from the start of displaying effect image 18 to the receiving of the stop request is less than or equal to a first threshold (e.g., 5 seconds) (YES in S203), data acquirer 26 learns that the user is not in the mode (mood) to enjoy effect image 18 (S204). In this case, controller 28 stops the display of effect image 18, and data acquirer 26 does not acquire effect image data to be displayed next time. With this, it is possible to avoid giving unnecessary stress to the user who is not in the mode of enjoying effect image 18.

Returning back to Step S203, when request receiver 24 receives the change request and the time from the start of displaying effect image 18 to the receiving of the change request is less than or equal to a second threshold (e.g., 5 seconds) (NO in S203, YES in S205), data acquiring section 26 learns that effect image 18 currently displayed on display surface 20 of window 6 does not meet the user's preference (S206), It should be noted that, when request receiver 24 receives the change request more than once in succession, the second threshold may be increased every time the number of times the change request is received increases. This is because that, although it is clear that the user desires another effect image 18 to be displayed, it is considered that the user is searching for effect image 18 that is completely to the user's preference while trying similar type of effect image 18. It is thus highly likely that effect mage 18 matches the user's preference, and it is possible to learn the user's preferences more accurately.

Returning back to Step S203, when request receiver 24 receives the change request and the time from the start of displaying of effect image 18 to the receiving of the change request exceeds a third threshold (e.g., 5 minutes) which is longer than the second threshold (NO in S203, NO in S205, YES in S207), data acquirer 26 learns that effect image 18 currently displayed on display surface 20 of window 6 meets the user's preference (5208).

Returning back to Step S203, when request receiver 24 receives the change request and the time from the start of displaying effect image 18 to the receiving of the change request exceeds the second threshold and less than or equal to the third threshold (NO in S203, NO in S205, NO in S207), it is difficult to determine whether or not effect image 18 currently displayed on display surface 20 of window 6 meets the user's preference, and thus data acquirer 26 ends the process without learning the user's preference. In the manner as described above, the results of learning the user's preferences by data acquirer 26 are accumulated every time the number of times the user uses smart window device 2 increases.

1-4. Advantageous Effects

As described above, data acquirer 26 acquires effect image data indicating effect image 18 that reflects the user's preference that has been learned based on: the length of time from the start of displaying effect image 18 until request receiver 24 receives a stop request or a change request; and the type of object 16. In addition, controller 28 selects effect image 18 to be displayed on display surface 20 of window 6 from among a plurality of effect image data, based on the type of object 16 that has been determined, and causes effect image 18 that has been selected to be displayed on display surface 20 of window 6.

With this, since effect image 18 displayed on display surface 20 of window 6 is an image reflecting the preference of the user, it is possible to create an effect in space according to the preference of the user.

In addition, when request receiver 24 receives a change request, controller 28 selects, from among a plurality of effect image data, another effect image 18 different from the above-described effect image 18 to be displayed on display surface 20 of window 6, and causes the other effect image 18 that has been selected to he displayed on display surface 20 of window 6.

With this, even when the user desires changing the display of effect image 18, it is possible to cause another effect image 18 that reflects the preference of the user on display surface 20 of window 6, and thus to create an effect in space according to the preference of the user.

Embodiment 2

2-1. Configuration of Smart Window Device

Figure 6:
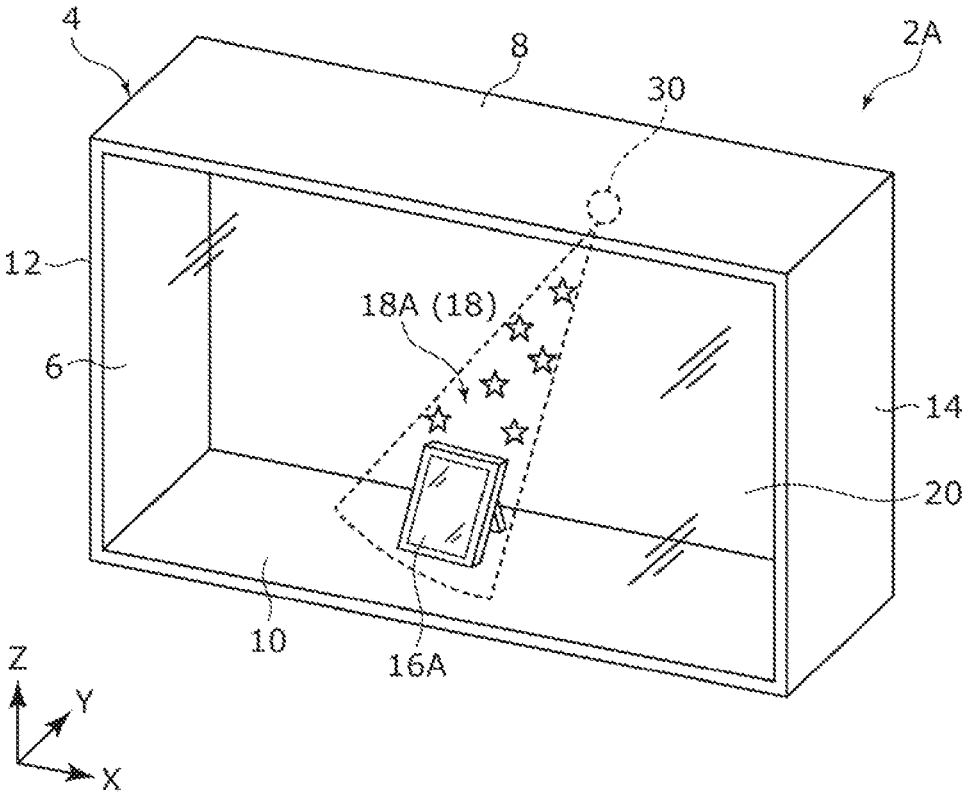
FIG. 6 is a perspective view Illustrating a smart window device according to Embodiment 2.

The following describes a configuration of smart window device 2A according to Embodiment 2, with reference to FIG. 6, FIG, 6 is a perspective view illustrating smart window device 2A according to Embodiment 2, It should be noted that, in the present embodiment, the same structural components as the above-described Embodiment 1 are assigned with the same reference signs, and redundant descriptions will be omitted.

As illustrated in FIG. 6, smart window device 2A according to Embodiment 2 includes light source 30 in addition to the structural components described in Embodiment 1 above. Light source 30 is, for example, a light emitting diode or the like, and is disposed on upper wall 8 of frame body 4. Light source 30 illuminates object 16A placed on lower wall 10 and also illuminates effect image 18 (18A) displayed on display surface 20 of window 6.

In the example illustrated in FIG. 6, object 16A is a photo frame, In addition, effect image 18A is an image which represents the scene of stars falling toward object 16A, and in which an image that imitates stars moving from an upper portion to a lower portion of window 6. In other words, in the example illustrated in FIG. 6, effect image 18A is an image that moves in the direction toward object 16A. It should be noted that, in the example illustrated in FIG. 6A, effect image 18A is displayed only on a portion of display surface 20, and the display range of effect image 18A is indicated by a dashed line.

2-2. Functional Configuration of Smart Window System

The following describes a functional configuration of smart window system 32 according to Embodiment 2, with reference to FIG, 7. FIG, 7 is a is a block diagram illustrating a functional configuration of smart window system 32 according to Embodiment 2.

Figure 7:
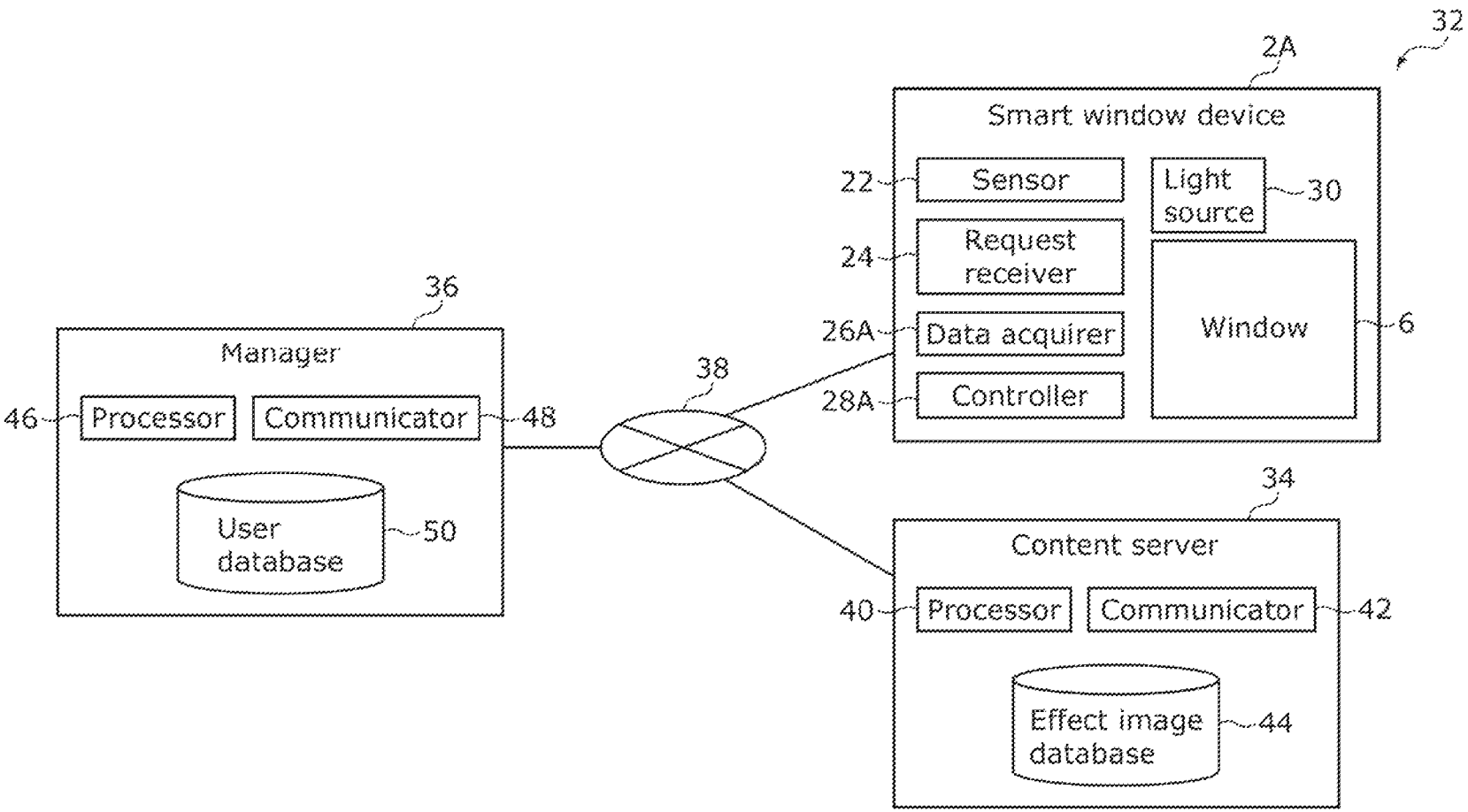
FIG. 7 is a block diagram illustrating a functional configuration of the smart window system according to Embodiment 2.

As illustrated in FIG. 7, the above-described smart window device 2A is integrated into smart window system 32, smart window system 32 includes smart window device 2A, content server 34, and manager 36. Each of smart window device 2A, content server 34, and manager 36 is connected to network 38 such as the Internet, for example.

Data acquirer 26A of smart window device 2A is connected to network 38, and transmits and receives data of various types to and from each of content server 34 and manager 36 via network 38. More specifically, data acquirer 26A acquires effect image data indicating effect image 18 reflecting a user's preference learned by manager 36 from content server 34 via network 38. In other words, unlike the above-described Embodiment 1, data acquirer 26A does not learn the preference of the user by itself. In addition, controller 28A of smart window device 2A controls the lighting of light source 30. It should be noted that each of request receiver 24, data acquirer 26A, and controller 28A of smart window device 2A functions as a processor.

Content server 34 is a server for distributing effect image data to smart window device 2A, and is, for example, a cloud server. Content server 34 includes processor 40, communicator 42, and effect image database 44. Processor 40 executes various processes for controlling content server 34. Communicator 42 transmits and receives data of various types to and from each of smart window device 2A and manager 36 via network 38. Effect image database 44 stores a plurality of effect image data each indicating effect image 18 reflecting a user preference that has been learned by manager 36.

Manager 36 is a server for learning the preference of a user. Manager 36 includes processor 46, communicator 48, and user database 50. Processor 46 executes various processes for controlling manager 36. Communicator 48 transmits and receives data of various types to and from each of smart window device 2A and content server 34 via network 38, User database 50 stores data related to a user who uses smart window device 2A.

2-3. Operation of Smart Window System

Figure 8:
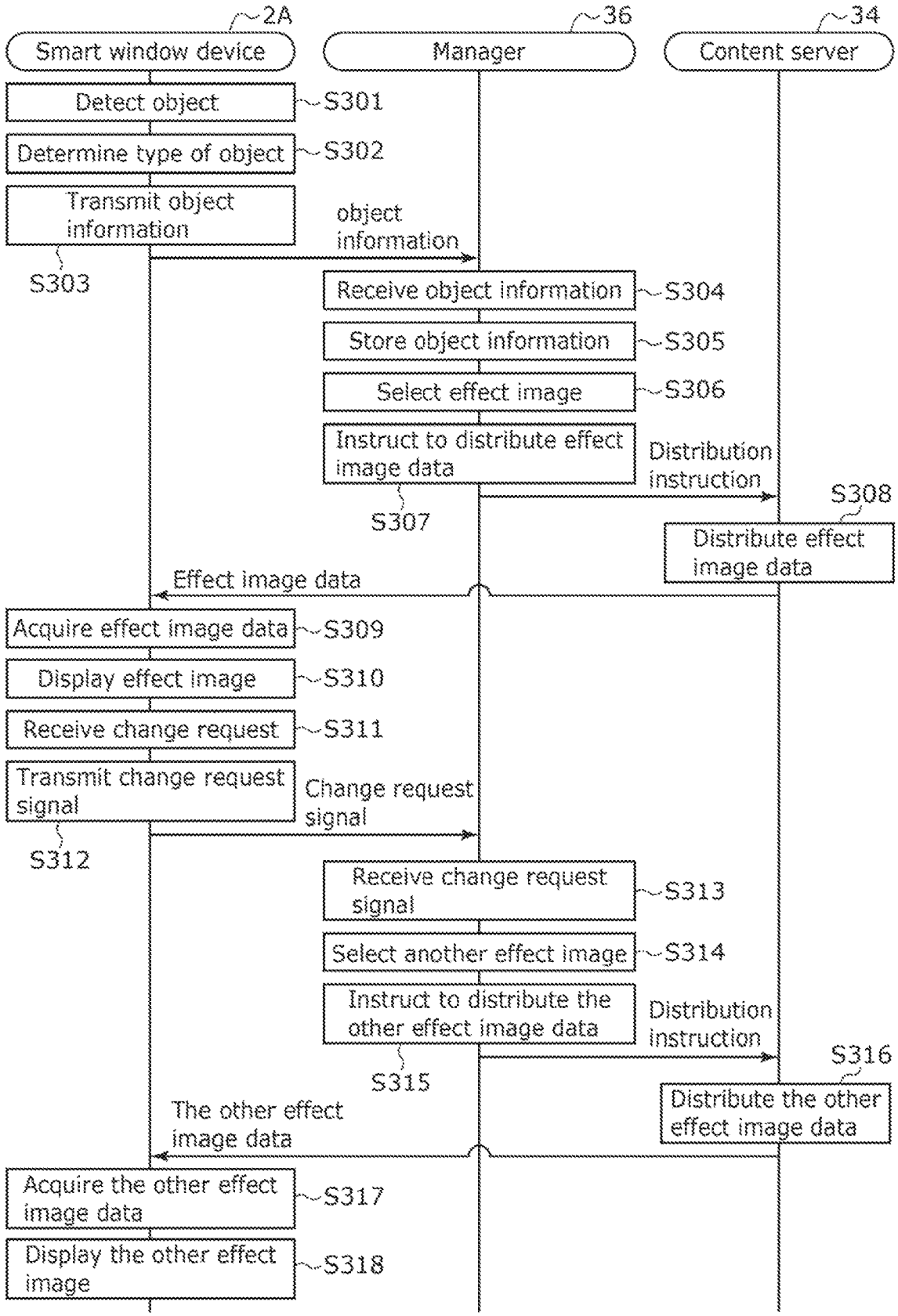
FIG. 8 is a sequence diagram illustrating an operational flow of the smart window system according to Embodiment 2.

The following describes an operation of smart window system 32 according to Embodiment 2, with reference to FIG. 8. FIG. 8 is a sequence diagram illustrating an operational flow of smart window system 32 according to Embodiment 2.

As illustrated in FIG. 8, when a user places object 16A (e,g., a photo frame) on lower wall 10 of frame body 4, sensor 22 of smart window device 2A detects object 16A placed on lower wall 10 (S301). Sensor 22 outputs image data indicating the captured image of object 16A to controller 28A.

Controller 28A of smart window device 2A determines the type of object 16A based on the image data from sensor 22 (S302). Data acquirer 26A of smart window device 2A transmits object information indicating the type of object 16A that has been determined by controller 28A to manager 36 via network 38 (S303).

Communicator 48 of manager 36 receives the object information from smart window device 2A (S304), and stores the received object information into user database 50 (S305). User database 50 stores therein a data table in which identification information for identifying a user and object information that has been received are associated.

Based on the object information that has been received, processor 46 of manager 36 selects effect image 18 (a first effect image) to be displayed on display surface 20 of window 6, from among a plurality of effect image data stored in effect image database 44 of content server 34 (S306). For example, as illustrated in FIG. 6 described above, processor 46 selects effect image 18A that is an image representing a scene of stars falling toward object 16A, as effect image 18 that matches "photo frame" that is the type of object 16A. Communicator 48 of manager 36 transmits a distribution instruction signal that instructs to distribute the effect image data indicating effect image 18 that has been selected, to content server 34 via network 38 (S307).

Based on the distribution instruction signal from manager 36, communicator 42 of content server 34 distributes (transmits) the effect image data indicating effect image 18 that has been selected by manager 36 to smart window device 2A via network 38 (S308).

Data acquirer 26A of smart window device 2A acquires (receives) the effect image from content server 34 (S309). Controller 28A of smart window device 2A selects effect image 18 indicated by the effect image data that has been acquired, and causes effect image 18 that has been selected to be displayed on display surface 20 of window 6 (S310). In other words, effect image 18 selected by controller 28A is the effect image that reflects the preference of the user that has been learned by manager 36 and is associated with the type of object 16A that has been determined.

The following describes the case where request receiver 24 of smart window device 2A receives a change request. When request receiver 24 receives a change request (S311), data acquirer 26A of smart window device 2A transmits a change request signal to manager 36 via network 38 (S312).

Communicator 48 of manager 36 receives the change request signal from smart window device 2A (S313). Based on the change request signal that has been received, processor 46 of manager 36 selects, from among a plurality of effect image data stored in effect image database 44 of content server 34, another effect image 18 (a second effect image) different from effect image 18 currently displayed on display surface 20 of window 6 (S314). At this time, processor 46 learns the preference of the user in the same manner as described in the flowchart of FIG. 5 of Embodiment 1 above.

Communicator 48 of manager 36 transmits a distribution instruction signal that instructs to distribute the effect image data indicating the other effect image 18 that has been selected, to content server 34 via network 38 (S315).

Based on the distribution instruction signal from manager 36, communicator 42 of content server 34 distributes (transmits) another effect image data indicating the other effect image 18 that has been selected by manager 36 to smart window device 2A via network 38 (S316).

Data acquirer 26A of smart window device 2A acquires (receives) the other effect image from content server 34 (S317), Controller 28A of smart window device 2A selects the other effect image 18 indicated by the other effect image data that has been acquired, and causes the other effect image 18 that has been selected to be displayed on display surface 20 of window 6 (S318). In other words, the other effect image 18 selected by controller 28A is the effect image that reflects the preference of the user that has been learned by manager 36 and is associated with the type of object 16A that has been determined.

It should be noted that the operation of smart window device 2A in the case where request receiver 24 receives a stop request is the same as in Embodiment 1 described above, and thus descriptions will be omitted.

2-4. Advantageous Effects

As described above, according to the present embodiment, since manager 36 learns the preference of the user, it is possible to reduce the processing load on smart window device 2A.

(Other Variations)

Although a smart window device and an image display method according to one or more aspects have been described based on the above-described embodiments, the present disclosure is not limited to the above-described embodiments, Other forms in which various modifications apparent to those skilled in the art are applied to the embodiments, or forms structured by combining structural components of different embodiments may be included within the scope of the one or more aspects, unless such changes and modifications depart from the scope of the present disclosure, Although the case where window 6 is an interior window has been described in the above-described embodiments, window 6 is not limited to this example, and may be, for example, a transparent exterior window installed in an opening formed in the exterior wall of a building, or a partition window dividing one room in a building into a plurality of spaces. In addition, window 6 may be, for example, a window with a decorative shelf or the like, or a lattice window divided into a plurality of grid-like spaces.

Although object 16 (16A) is placed in a position facing the rear side of window 6 in the above-described embodiments, the placement position of object 16 (16A) is not limited to this example. Object 16 (16A) may be placed in a position in proximity to the lower portion of window 6 and facing the front side (interior side) of window 6, or may be placed in any position in proximity to window 6.

Although sensor 22 captures an image of object 16 (16A) in the above-described embodiments, the present disclosure is not limited to this example, and sensor 22 may optically read a barcode printed or pasted on the surface of object 16. This barcode includes identification information to identify the type of object 16. In this case, controller 28 (28A) determines the type of object 16 (16A) based on the identification information included in the barcode that has been read by sensor 22.

Although controller 28 (28A) causes effect image 18 to be displayed on a portion of display surface 20 of window 6 in the above-described embodiments, the present disclosure is not limited to this example, and controller 28 (28A) may cause effect image 18 to be displayed on the entire display surface 20.

In addition, data acquirer 26 (26A) may acquire, from the network, user information which indicates the schedule of a user and/or the operation history of a device (e.g, home appliance device or mobile device, etc.) by the user. In this case, controller 28 (28A) may predict, based on the above-described user information, a time at which the user enters the room in which window 6 is installed, and start displaying effect image 18 a first period of time (e.g., 5 minutes) before the time that has been predicted.

In addition, sensor 22 may detect whether or not a user is present in the room in which window 6 is installed, In this case, controller 28 (28A) may stop displaying effect image 18 after a second period of time (e.g., one minute) has elapsed from the time at which sensor 22 detected that the user is no longer present in the room.

In addition, sensor 22 may detect an illuminance in proximity to window 6. In this case, controller 28 (28A) may adjust the luminance when displaying effect image 18 on display surface 20 of window 6, based on the illuminance that has been detected by sensor 22. For example, when the illuminance detected by sensor 22 is relatively high, controller 28 (28A) adjusts the luminance when displaying effect image 18 on display surface 20 of window 6 to be relatively high, and when the illuminance detected by sensor 22 is relatively low, controller 28 (28A) adjusts the luminance when displaying effect image 18 on display surface 20 of window 6 to be relatively low.

In addition, the preference of the user may be learned based on the operation history of smart window device 2 (2A) by the user. More specifically, the user may register his/her own preferences in advance by operating smart window device 2 (2A). Alternatively, the preference of the user may be learned based on the operation history of other devices (e.g., home appliances or mobile devices) other than smart window device 2 (2A). More specifically, for example, when the user has been highly frequently viewing images of the starry sky on the smartphone, the preference of the user may be learned such that the user prefers effect image 18 that represents the starry sky.

In addition, controller 28 (28A) may acquire situation data indicating the situation of the room in which window 6 is installed, and select effect image 18 according to the situation of the room indicated by the situation data from among a plurality of effect image data. More specifically, for example, when the situation data indicates, as the situation of the room, that "many people are in the room", controller 28 (28A) selects splashy effect image 18. On the other hand, for example, when the situation of the room indicated by the situation data is that "one person is in the room", controller 28 (28A) selects chill-out effect image 18.

In addition, when sensor 22 detects a plurality of objects 16 (16A), controller 28 (28A) may select only one object 16 (16A) suitable for effect image 18 from the plurality of objects 16 (16A), For example, when sensor 22 detects three objects, i.e., a key, a wallet, and a Christmas tree, controller 28 (28A) selects Christmas tree which is the most decorative among these three objects. With this, it is possible to avoid effect image 18 that is miscellaneous and less likely to contribute to creating an effect in space (Le., effect image 18 associated with the key or wallet) from being displayed on display surface 20 of window 6.

It should be noted that when sensor 22 detects a plurality of objects 16 (16A), the method of determining the levels of decorativeness of the plurality of objects 16 (16A) may be to exclude objects of high utility (e.g., keys and wallets) by determining the types of the plurality of objects 16 (16A) by controller 28 (28A). Alternatively, the method may be to search effect image data on the network based on the types of the plurality of objects 16 (16A) that have been determined, and select the object associated with the effect image data with the most celebratory mood among the search results.

Each of the structural components in each of the above-described embodiments may be configured in the form of an exclusive hardware product, or may be realized by executing a software program suitable for each of the structural components. Each of the structural components may be realized by means of a program executing unit, such as a CPU and a processor, reading and executing the software program recorded on a recording medium such as a hard disk or a semiconductor memory.

In addition, some or all of the functions of smart window device according to the above-described embodiments may be implemented by a processor, such as a CPU, executing a program.

A part or all of the structural components constituting the respective apparatuses may be configured as an IC card which can be attached and detached from the respective apparatuses or as a stand-alone module. The IC card or the module is a computer system configured from a microprocessor, a ROM, a RAM, and so on. The IC card or the module may also include the aforementioned super-mufti-function LSI. The IC card or the module achieves its function through the microprocessor's operation according to the computer program. The IC card or the module may also be implemented to be tamper-resistant, The present disclosure may also be realized as the methods described above. In addition, the present disclosure may be a computer program for realizing the previously illustrated methods using a computer, and may also be a digital signal including the computer program. Furthermore, the present disclosure may also be realized by storing the computer program or the digital signal in a non-transitory computer readable recording medium such as flexible disc, a hard disk, a CD-ROM, an MO, a DVD, a DVD-ROM, a DVD-RAM, a BD (Blu-ray (registered trademark) Disc), and a semiconductor memory. Furthermore, the present disclosure may also include the digital signal recorded in these recording media. In addition, the present disclosure may also be realized by the transmission of the aforementioned computer program or digital signal via a telecommunication line, a wireless or wired communication line, a network represented by the Internet, a data broadcast and so on Furthermore, the present disclosure may also be a computer system including a microprocessor and a memory, in which the memory stores the aforementioned computer program and the microprocessor operates according to the computer program. In addition, by transferring the program or the digital signal by recording onto the aforementioned recording media, or by transferring the program or digital signal via the aforementioned network and the like, execution using another independent computer system is also made possible.

INDUSTRIAL APPLICABILITY

The present disclosure is useful, for example, for smart window devices, etc. for creating an effect in space.

The invention claimed is:

1. A smart window device for creating an effect in space, the smart window device comprising:

a window that is transparent and includes a display surface on which an effect image is displayed, the window being see-through from one side to an other side of the display surface while the effect image is displayed on the display surface;

a request receiver that receives, from a user, a stop request to stop display of the effect image or a change request to change display of the effect image;

a data acquirer that acquires effect image data that indicates the effect image reflecting a preference of the user learned based on a length of time from a start of displaying the effect image until the request receiver receives the stop request or the change request and a type of an object located in proximity to the window; and a controller that: (i) when a sensor detects the object, determines the type of the object based on a detection result of the sensor, selects a first effect image to be displayed on the display surface from among a plurality of effect image data each being the effect image data, based on the type of the object determined, and causes the first effect image to be displayed on at least a portion of the display surface; (ii) when the request receiver receives the stop request, stops displaying the first effect image; and (iii) when the request receiver receives the change request, selects a second effect image different from the first effect image to be displayed on the display surface from among the plurality of effect image data, and causes the second effect image to be displayed on at least a portion of the display surface.

2. The smart window device for creating the effect in space according to claim 1, wherein the window is any one of: an exterior window installed in an opening provided in an exterior wall of a building; an interior window installed between two adjacent rooms in the building; and a partition window dividing one room in the building into a plurality of spaces.

3. The smart window device for creating the effect in space according to claim 1, wherein at least one of the first effect image or the second effect image includes an image of a plurality of grains of light moving from an upper portion toward a lower portion of the window.

4. The smart window device for creating the effect in space according to claim 1, wherein the controller causes each of the first effect image and the second effect image to be displayed on at least a portion of the display surface such that a movement direction of each of the first effect image and the second effect image is directed toward the object.

5. The smart window device for creating the effect in space according to claim 1, wherein the data acquirer is connected to a network, and acquires the effect image data from the network.

6. The smart window device for creating the effect in space according to claim 5, wherein the data acquirer further acquires user information indicating at least one of a schedule of the user or a history of operating a device by the user, and the controller predicts, based on the user information, a time at which the user enters a room in which the window is installed, and starts displaying the first effect image a first period of time before the time predicted.

7. The smart window device for creating the effect in space according to claim 1, wherein the sensor further detects whether the user is present in a room in which the window is installed, and the controller stops displaying the first effect image or the second effect image after a second period of time has elapsed after the sensor detects that the user is no longer present in the room.

8. The smart window device for creating the effect in space according to claim 1, wherein the sensor further detects an illuminance in proximity to the window, and the controller adjusts a luminance when displaying the first effect image or the second effect image on the window, based on the illuminance detected by the sensor.

9. The smart window device for creating the effect in space according to claim 1, wherein the window is a transmissive transparent display including any one of a transparent inorganic electro luminescence (EL), a transparent organic EL, and a transmissive liquid crystal display.

10. The smart window device for creating the effect in space according to claim 1, wherein the preference of the user is further learned based on a history of operating the smart window device by the user or a history of operating another device other than the smart window device by the user.

11. The smart window device for creating the effect in space according to claim 1, wherein the controller acquires situation data indicating a situation of a room in which the window is installed, and selects the first effect image or the second effect image according to the situation of the room indicated by the situation data from among the plurality of effect image data.

12. An image display method for creating an effect in space in a smart window system including a window and a processor, the window being transparent, including a display surface on which an effect image is displayed, and being see-through from one side to an other side of the display surface while the effect image is displayed on the display surface, the image display method comprising:

detecting an object located in proximity to the window, by using a sensor; and causing the processor to perform the following:

receiving, from a user, a stop request to stop display of the effect image or a change request to change display of the effect image;

acquiring effect image data that indicates the effect image reflecting a preference of the user learned based on a type of the object and a length of time from a start of displaying the effect image to the receiving of the stop request or the change request;

when the sensor detects the object, determining the type of the object based on a detection result of the sensor, selecting a first effect image to be displayed on the display surface from among a plurality of effect image data each being the effect image data, based on the type of the object determined, and causing the first effect image to be displayed on at least a portion of the display surface;

when the stop request is received in the receiving, stopping displaying of the first effect image, and when the change request is received in the receiving, selecting a second effect image different from the first effect image to be displayed on the display surface from among the plurality of effect image data, and causing the second effect image to be displayed on at least a portion of the display surface.

13. A non-transitory computer-readable recording medium having a program recorded thereon for causing a computer to execute the image display method for creating the effect in space according to claim 12.

* * * * *